US005360526A

United States Patent [19]

Arimoto et al.

[11] Patent Number: 5,360,526

[45] Date of Patent: Nov. 1, 1994

[54] ELECTROLYTIC CELL

[75] Inventors: Osamu Arimoto, Okayama; Shinji Katayama, Tamano; Yoshinari Take, Okayama, all of Japan

[73] Assignee: Chlorine Engineers Corp. Ltd., Tokyo, Japan

[21] Appl. No.: 56,432

[22] Filed: Apr. 30, 1993

[30] Foreign Application Priority Data

Apr. 30, 1992 [JP] Japan ..... 4-111673

[51] Int. Cl.[5] ..... C25B 9/00; C25B 11/02

[52] U.S. Cl. ..... 204/242; 204/252; 204/282; 204/288; 204/289

[58] Field of Search ..... 204/286–289, 204/252, 282, 242

[56] References Cited

U.S. PATENT DOCUMENTS 4,855,032 8/1989 Fabian et al. ..... 204/288 X 5,254,233 10/1993 Nakao et al. ..... 204/279 X

*Primary Examiner*—Donald R. Valentine

*Attorney, Agent, or Firm*—Kuhn and Muller

[57] ABSTRACT

An electrode (14) is joined to ridges (12) or ribs of a partition (11) by means of spring members (13), each being in comb form and bent at the toothed portions (16) thereof, so that, while the electrode surface is kept flat, the toothed portions (16) can be held with any desired distance with respect to electrode-supporting portions such as the partition or its ribs, but without causing damage to an ion-exchange membrane.

3 Claims, 3 Drawing Sheets

ELECTROLYTIC CELL

BACKGROUND OF THE INVENTION

The present invention relates generally to an electrolytic cell and, more particularly, to a filter press type electrolytic cell having electrodes with the inter-electrode gap so reduced that the electrolytic voltage can be reduced considerably.

The filter press type electrolytic cell has wide applications in organic material production by electrolysis, inclusive of the production of chlorine and caustic soda by brine electrolysis, seawater electrolysis, etc.

FIG. 4(A) is a schematic representation of a filter press type of bipolar electrolytic cell unit used typically for brine electrolysis; the illustration being a partly cut-away plan view of the electrolytic cell unit shown generally as 41, and FIG. 4(B) a sectional view thereof taken along line A—A of FIG. 4(A).

An anodic-side partition 42 of an electrolytic cell unit 41 is obtained by corrugating or otherwise forming a member selected from a thin film-forming metal such as titanium, zirconium or tantalum and its alloy into a pan form of corrugated thin sheet. Likewise, a cathodic-side partition 43 is obtained by corrugating or otherwise forming a member of iron, nickel, stainless steel or like material into a corrugated thin sheet. These partitions are mounted on an electrolytic cell frame 44. Both the partitions have grooves and ridges that are engaged with each other; the anodic-side partition 42 is provided with grooves 45 and ridges 46, and the cathodic-side partition 43 is provided with similar grooves 47 and ridges 48 at positions where they are engaged within and with the ridges 46 and grooves 45 on the anodic side, respectively.

Neither grooves nor ridges are formed on the portions of the partitions 42, 43 adjacent to the upper, lower, right and left walls of each electrode chamber, thereby defining an electrolyte-circulation path therein. An anode 49 is attached, as by welding, to the ridges of the anodic-side partition 42, said anode being formed by applying an anodically active coating made of an oxide of a metal such as a metal of the platinum group on an expanded metal sheet, a porous sheet, etc. Likewise, a cathode 50 is joined, as by welding, to the ridges 48 of the cathodic-side partition 43, said cathode being formed by applying a cathodically active coating made of a metallic substance such as a metal of the nickel or platinum group to an expanded metal sheet, a perforated sheet, or the like.

A very large current of usually a few tens kiloamperes to a few hundred kiloamperes passes through an electrolytic cell; even slight reductions in the electrolytic voltage make some considerable contribution to power consumption reductions. The performance of the electrolytic cell is estimated by many factors, among which the voltage required for electrolysis becomes a very important element.

The voltage needed for electrolysis depends on electrodes, ion-exchange membranes, electrolytic cell structure, running temperatures, the distance between both electrodes of the electrolytic cell, and other factors, and many proposals have been put forth of improvements in electrodes, ion-exchange membranes, electrolytic cell structure, and running conditions.

Of the factors having an influence on electrolytic voltage, an inter-electrode distance reduction in particular is a vital factor that leads to an electrolytic voltage reduction, and various proposals have been made for reduction of the inter-electrode distance.

In brine electrolysis by ion-exchange membrane techniques using a cation-exchange membrane, it has now been found that it is possible to reduce the electrolytic voltage by reducing the distance between the anode and the cation-exchange membrane. This enables an electrolytic cell to be run, while the cation-exchange membrane is brought in close contact with the anode by a pressure difference produced between the cathodic and anodic chambers by making the pressure in the cathodic chamber higher than that in the anodic chamber.

When the electrolytic voltage is reduced in view of the inter-electrode distance, therefore, it is generally important to reduce the distance between the cathode and the cation-exchange membrane.

A proposal has also been put forth of an electrolytic cell, in which the distances between the anode and the cation-exchange membrane as well as the cathode and the cation-exchange membrane are substantially reduced to zero. Although, depending on the type of the cation-exchange membrane used, close contact of the cathode therewith is not always preferable for the performance of the cation-exchange membrane and electrolysis. In the case of such a cation-exchange membrane, it is required to space the cathode away from the cation-exchange membrane with a certain distance.

In order to bring the cation-exchange membrane in close contact with the cathode or keep them with a very short distance between them, it has been proposed to join the partitions or ribs of the electrolytic cell to the electrodes using expanding and contracting members such as springs.

Either in the case of bringing the cation-exchange membrane in close contact with the cathode or in the case of spacing them away from each other a very short distance, it is required to keep the inter-electrode distance and the distance between the cathode and the ion-exchange membrane with high dimensional accuracy. In the case of an electrolytic cell used for brine electrolysis, etc., which uses a movable electrode having a surface area as large as a few square meters, however, it is very difficult to keep the electrode surface uniformly spaced by means of a member such as a spring. An uncertain inter-electrode distance gives rise to uneven current distribution, and so poses several problems such as a local failure of the electrodes and ion-exchange membranes, the performance of the electrolytic cell being adversely affected.

SUMMARY OF THE INVENTION

The present invention provides an electrolytic cell on which an electrode formed of expanded metal, etc., is mounted by means of a flexible spring member attached to a partition or power supply rib of the electrolytic cell so as to narrow the space between the electrode and a cation-exchange membrane and thereby achieve an electrolytic voltage reduction. The cation-exchange membrane is spaced away from the electrode with a high accuracy, the surface of said electrode being kept at a certain height by the resilient force of said spring member. The spring member used is in comb form, and is provided with teeth at one side, extending from a strip body of the comb and being bent to define springs having uniform spring properties. It is thus possible to keep the electrode surface uniform with a desired distance between the electrode and the ion-exchange membrane, when that spring member is built in the electrolytic cell.

According to the invention, the electrode is coupled to a partition or rib of the electrolytic cell by means of a comb-form of spring member having bent teeth. Thus, while the electrode surface is kept flat, the toothed portions of the spring member enable the electrode to be spaced away from the electrode-supporting portion of the cell, such as the partition or rib, as desired. Even when the electrode is into contact with the ion-exchange membrane by resilient force, it is unlikely that the electrode may cause damage to the ion-exchange membrane. The spring member, because of having an integral structure, can be easily fabricated, and can be easily attached to the partition, etc., of the electrolytic cell as well.

DESCRIPTION OF THE PREFERRED EMBODIMENT

The application of the invention to a spring member-incorporated electrolytic cell unit that forms a filter press type of bipolar brine electrolysis cell will now be explained at great length with reference to the drawings.

Figure 1:
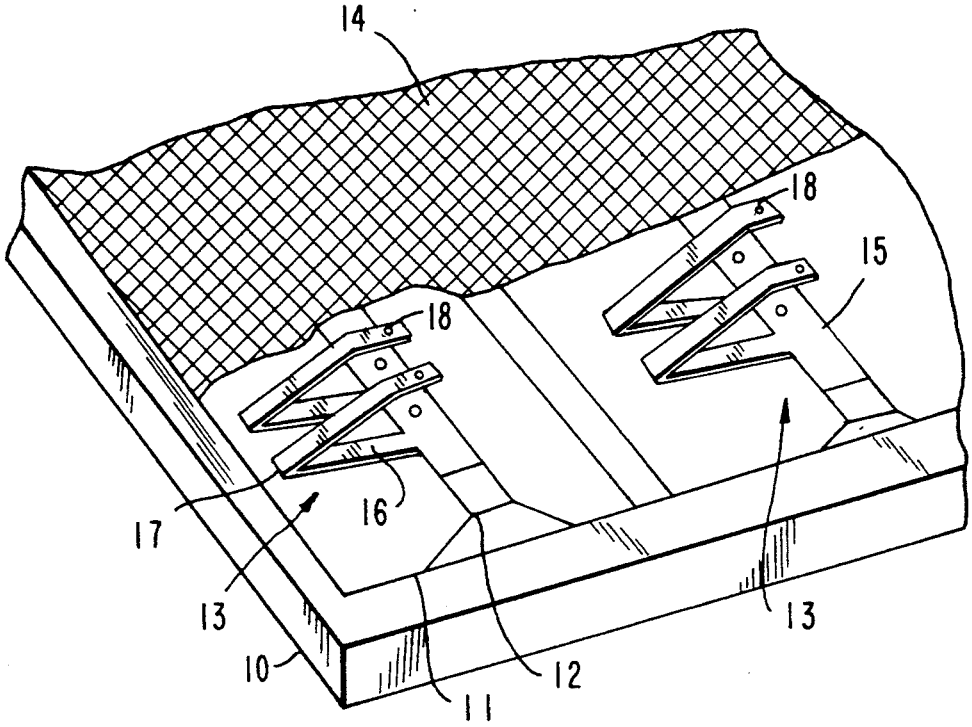
FIG. 1 is a perspective view of a portion part broken away, of an electrolytic cell, according to the invention, that is attached to an electrode.

FIG. 1 is a partly cut-away perspective view of a bipolar electrolytic cell unit for brine electrolysis, shown generally as 10. The electrolytic cell unit 10 includes a corrugated thin-sheet partition 11. An electrode 14 is then attached to the ridges 12 of the thin sheet partition 11 by means of spring members 13 in comb form. Each spring member 13 is attached at its strip 15 to each ridge 12 of the partition 11. A tooth 16 of the comb-form of spring member 13 is provided with a bend 17, and is welded or otherwise joined at the end 18 to the electrode 14.

In fabricating the electrolytic cell unit 10 of the present invention, it is possible to keep constant the resilient forces of the spring portions formed by the teeth 16 of the spring member 13, because each spring member 13 is formed as one piece. Since each comb-form of spring member 13 is attached at the connecting strip 15 to the corrugated thin-sheet partition 11, the portion 12 attached to the partition 11 and the portion 18 attached to the electrode 14 are preferably not on the same plane vertical with respect to the electrode 14. This enables the spring members 13 to be easily welded or otherwise attached to the partition 11 of the electrolytic cell unit 10 and to the electrode 14 as well. At the same time, attachment of the electrode 14 to the spring members 13 is achievable so easily that the electrolytic cell can be fabricated within a short period of time. Further, the spring members 13, because of being in comb form, are unlikely to form a barrier against the circulation of electrolyte or air bubbles formed in the electrolytic cell.

Figure 2:
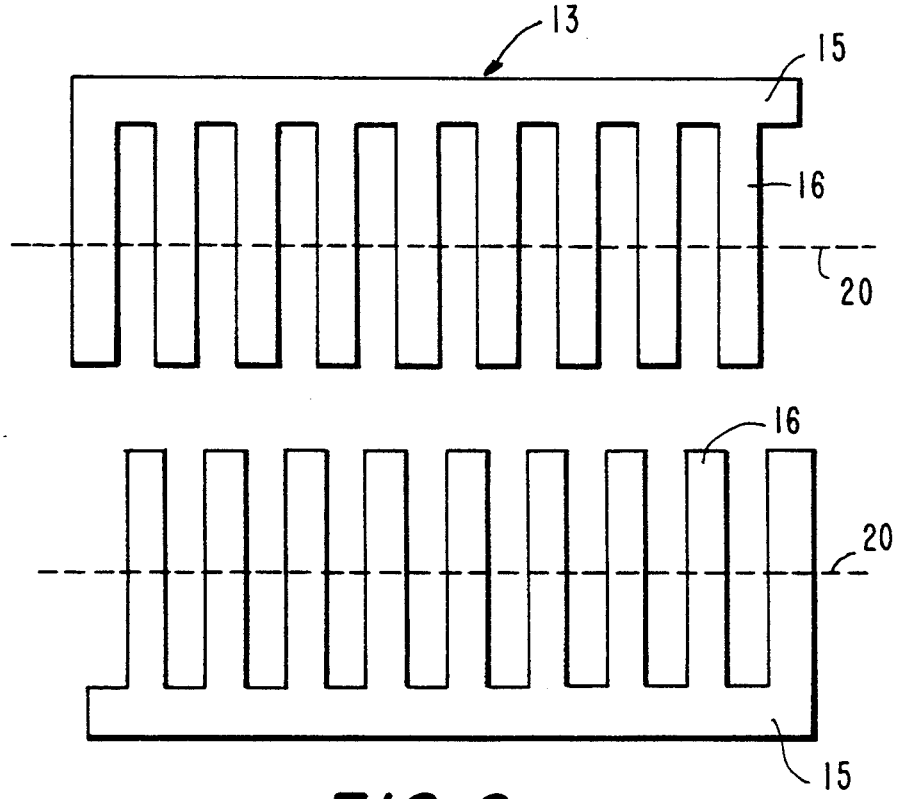
FIG. 2 is an illustration of how to fabricate the spring member according to the invention.

FIG. 2 is an illustration of how to form a spring member 13 of a thin metal sheet. As illustrated, two spring portions 13 of the same configuration are punched or otherwise formed out of the thin sheet; they can be obtained by a single cutting operation. Then, they can be bent along dotted lines 20 into spring members.

The present invention is applicable not only to a bipolar electrolytic cell but also to a monopolar electrolytic cell. For instance, a monopolar electrolytic cell with a reduced inter-electrode distance can be obtained by coupling the spring members to mounting rigs of the electrode forming the electrolytic cell.

EXAMPLE 1

With an electrolytic cell including an electrode having a size of 1,400 mm and 935 mm and an effective electrode area of 130.9 $dm^2$, DSE made by Pelmelec Electrode Co., Ltd. was used as an anode and expanded metal of activated nickel having a thickness of 0.8 mm was used as a cathode. The cathode was attached to the partition of the electrolytic cell by means of spring members of nickel in comb form.

NE 962 (made by Du Pont) was used as a cation-exchange membrane. While the anode was in close contact with the cation-exchange membrane with a varying distance between the cathode and the cation-exchange membrane, saturated brine was supplied to the electrolytic cell at an electrolysis temperature of 90 degrees C. and a current density of 50 $A/dm^2$ for the electrolytic production of a 32% sodium hydroxide.

The electrolytic voltage, when the cathode was in close contact with the cation-exchange membrane, was 3.105 V. When the cation-exchange membrane was spaced 2 mm away from the cathode, the electrolytic voltage was 3.285 V. Thus, a 180 mV electrolytic voltage reduction was achieved by bringing the cathode in close contact with the cation-exchange membrane. A 161.4 mV voltage drop is achieved with a 18.6 mV voltage drop due to the spring members being used.

EXAMPLE 2

Two spring members in comb form of 8 mm in width and 90 mm in length were formed exhaustively of a nickel sheet of 0.5 mm in thickness, 110 mm in length and 288 in width. A comb form of strip that forms each spring member was attached at 10 mm-portions of the ends of its teeth to an electrode, and was bent at its portions of 50 mm in length from the ends with the strip portion being 10 mm in width. Expanded metal was then welded to those 10 mm-portions.

A very-ultra-low-pressure sensitive paper (made by Fuji Photo Film Co., Ltd. and sold under the trade name of Prescale for very-ultra-low pressure) was applied over a sheet. Then, a member including spring members with the electrode coupled to them was pressed against the very-ultra-low-pressure sensitive recording paper in close contact with the electrode to cause a 5-mm displacement of the spring members. At this time, the distribution of pressure over the very-ultra-low-pressure sensitive recording paper was observed.

Figure 3:
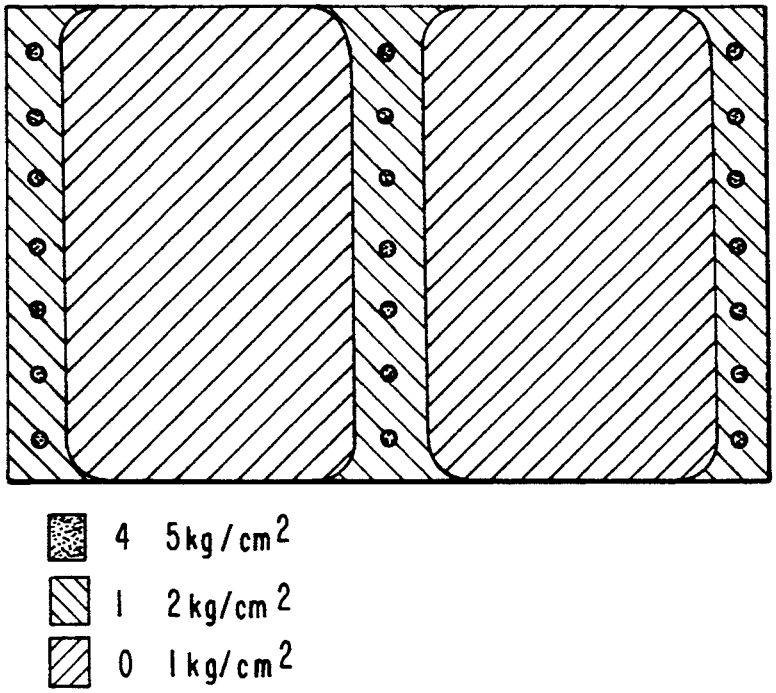
FIG. 3 is an illustration of a pressure distribution over the surface of the electrode joined to the spring member.
Figure 4A:
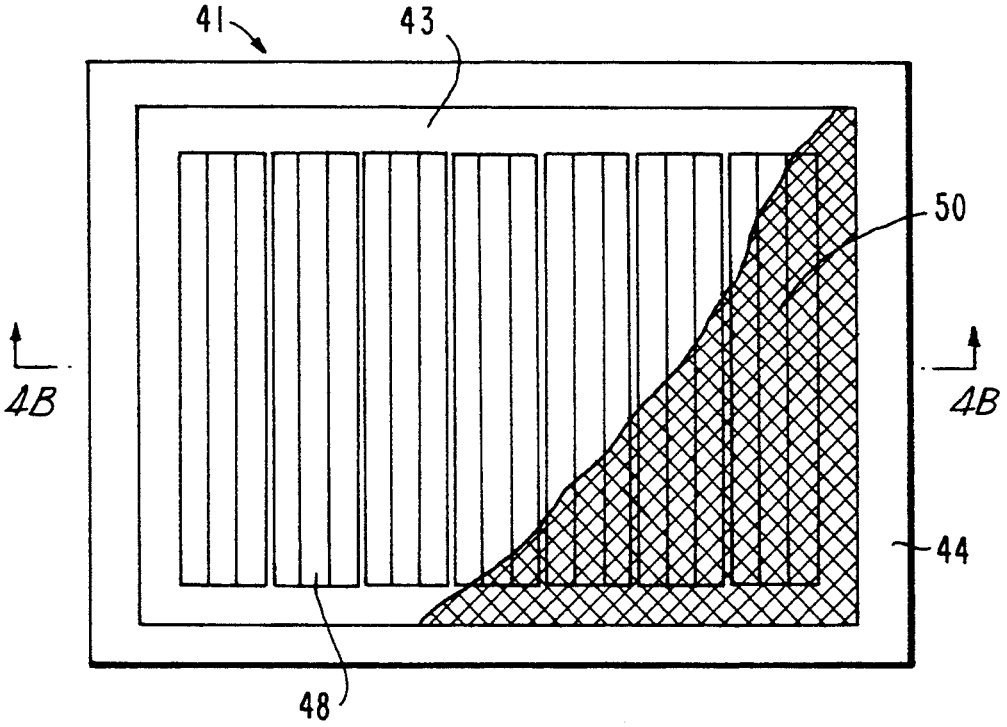
FIG. 4(A) is a schematic representation, part broken away, of an electrolytic cell unit forming a bipolar electrolytic cell.
Figure 4B:
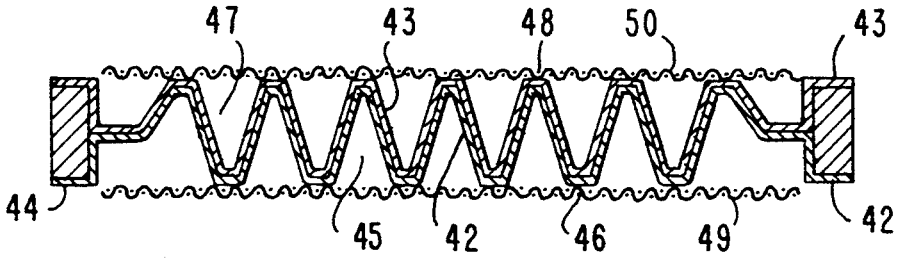
FIG. 4(B) is a cross-sectional view taken along line A—A of FIG. 4(A) .

As can be seen from the obtained results shown in FIG. 3, the spots of the spring members welded to the electrode showed a pressure distribution of 4 to 5 $kg/cm^2$, the portions of the spring members to the electrode a pressure distribution of 1 to 2 $kg/cm^2$, and the rest a pressure distribution of 0 to 2 kg/cm$^2$. It is also seen that the pressure applied to the ion exchange membrane at the welded sports was not high enough to have an adverse influence on the ion exchange membrane.

As evident from the foregoing, the present invention provides an electrolytic cell having an electrode attached thereto by means of a spring member that is in comb form with its teeth bent. In this electrolytic cell, while the electrode surface is kept in a very smooth state, it can be retained with any desired spacing with respect to an opposite electrode or an ion exchange membrane. Thus, the electrode is easily attached to the partition of the electrolytic cell, and is held with any desired distance with respect to an ion exchange membrane, etc., but without causing damage thereto, so that the electrolytic voltage can be reduced considerably.

What we claim:

1. An electrolytic cell with a movable electrode attached thereto, comprising an electrode which is spacedly joined to free ends of a plurality of teeth spring means projecting from a strip member which is attached to a partition or rib support member of the electrolytic cell wherein said electrode is adjustably spaced from said partition or rib support member.

2. An electrolytic cell as claimed in claim 1, wherein said electrolytic cell is partitioned by an ion-exchange membrane.

3. An electrolytic cell as claimed in claim 1, wherein said spring means is electrolytic current conducting means.

* * * * *